US005551890A

United States Patent [19]

Caherec

[11] Patent Number: 5,551,890

[45] Date of Patent: Sep. 3, 1996

[54] PATCH PANEL IDC CONNECTOR

[75] Inventor: Alain Caherec, Conflans Sainte Honorine, France

[73] Assignee: The Whitaker Corporation, Wilmington, Del.

[21] Appl. No.: 362,313

[22] Filed: Dec. 22, 1994

[30] Foreign Application Priority Data

Feb. 23, 1994 [FR] France ..... 94 02039

[51] Int. Cl.[6] ..... H01R 4/26

[52] U.S. Cl. ..... 439/409; 439/402

[58] Field of Search ..... 439/409, 410, 439/402, 417, 395

[56] References Cited

U.S. PATENT DOCUMENTS 4,536,049 8/1985 Wilmes ..... 439/409

5,368,501 11/1994 Asbell ..... 439/409

*Primary Examiner*—P. Austin Bradley

*Assistant Examiner*—Jeffrey T. Knapp

[57] ABSTRACT

An IDC connector comprises an insulative housing, a prismatic cavity, IDC contacts projecting thereinto and an actuator having a wire receiving hole and a screwdriver slot. Connection of an insulated conducting wire to the IDC is effectuated by inserting the wire into the cavity and then applying torque to the actuator by means of a screwdriver. Cooperation of the outer profile of the actuator with camming surfaces of the cavity causes simultaneous rotation and translation of the actuator, whereby the wire is translated in a linear manner into an IDC slot of the IDC for connection thereto. Disconnection is effectuated by simply reversing the torque on the actuator. The advantages of the invention are the accessibility of the wire and the screwdriver from the same direction, providing for a compact design; the quick and reliable visual inspection of the connections and additionally the cost-effectiveness due to the small number of parts and the simplicity thereof, such as the planar edge-stamped IDC.

12 Claims, 3 Drawing Sheets

PATCH PANEL IDC CONNECTOR

BACKGROUND OF THE INVENTION

1. Field of the Invention

This invention relates to a connector for insulation displacing connection to conducting wires, in particular for individual and repeated connection and disconnection, as occurs in telephone patch panels.

2. Description of the Prior Art

It is common, in particular in the telecommunications industry, to interconnect electrical wires to terminals having insulation displacing contacts (IDC) due to the simplicity and rapidity with which the termination can be effectuated. For such termination, it is often advantageous to provide an actuator for receiving and guiding the wire into the corresponding IDC slot for connection thereto, the actuator being actuable in a reverse manner to disconnect the wire therefrom. There are many different actuation means, however there are many problems associated with the prior art, for example: delicate or complicated actuation members, large space requirements, difficulty to actuate or to release—sometimes requiring special tools, difficult access to terminate the wire or to visually inspect termination of wires. Easy access and compact configuration are important but conflicting requirements.

It is known to provide a compact actuator as shown in FIG. 6, whereby the actuator 2' has wire receiving slots 4' and a screwdriver slot 6' for rotating the actuator such that conducting wires inserted into the slots 4' are stuffed into IDC slots of terminals (not shown). Some of the disadvantages of this design, is firstly: the difficulty to visually detect if a termination is complete or not, and secondly: the parts are complicated due to the arcuate movement of the wire, and the need to provide a stop means to limit rotation of the actuator. The latter is also detrimental to reliability and cost-effectiveness.

SUMMARY OF THE INVENTION

It is therefore an object of this invention to provide a connector for IDC connection having a compact configuration, yet enable easy connection and disconnection.

It is a further object of this invention to provide an IDC connector for repeatable connection and disconnection, whilst being reliable and cost-effective.

It is a further object of this invention to provide a connector for IDC connections to individual wires that is compact, easy to access without requiring specialized tools, and easy to visually inspect the state of connection or disconnection of the wires thereto.

The objects of this invention have been achieved by providing an IDC connector having a housing, an insulation displacing contact (IDC) mounted therein for connection to a conducting wire, and an actuator for guiding and inserting the wire into a slot of the IDC, characterized in that the housing comprises a cavity for receiving the actuator, the cavity having a camming surface cooperable with the actuator for guiding simultaneous rotational and translational movement thereof during insertion of the wire into the IDC slot. The actuator could comprise a wire receiving cavity proximate the IDC slot and extending substantially parallel to the rotational axis of the actuator.

DETAILED DESCRIPTION OF THE PREFERRED EMBODIMENT

Figure 1:
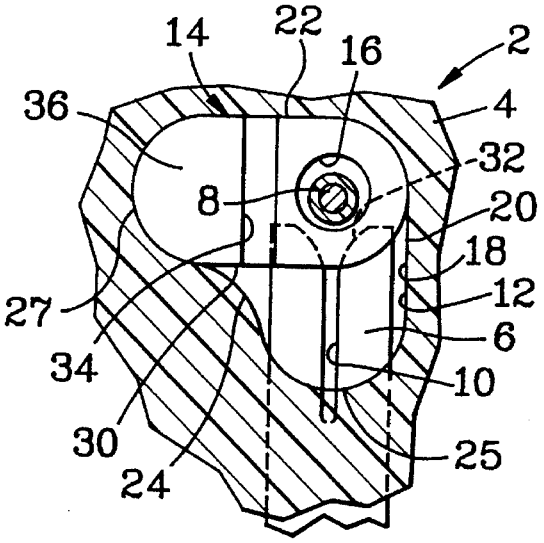
FIG. 1 is a view of an actuator in a housing cavity therefor, in a position for receiving a conducting wire therein.

Referring first to FIGS. 1–4, part of a connector 2 comprising an insulative housing 4 is shown having an insulation displacing contact (IDC) 6 for connection to a conducting wire 8. The insulation displacing contact 6 is a planar edge stamped sheet metal part, comprising a slot 10 for making electrical contact with conducting strands of the wire by displacing the outer insulation as the wire is forced into the slot. At the other end of the IDC 6 (not shown), may be attached any terminal means for connection to a complementary conductor. The housing 4 further comprises a cavity 12 receiving an actuator 14 having a wire receiving cavity 16 extending orthogonally to the plane of the IDC 6. The cavity 12 has a prismatic surface 18 extending orthogonally to the IDC 6, the cavity 12 having an L-shape whereby the IDC projects into one of the arms of the L. The cavity surface 18 has a linear portion 20 substantially parallel the IDC slot 10, an orthogonal portion 22 perpendicular thereto, and an arcuate camming portion 24 extending between diagonally disposed arcuate portions 25, 27 extending from the linear portions 20 and 22 respectively.

The actuator 14 is also substantially prismatic, having an oval outer profile 30 whereby the wire receiving cavity 16 is disposed proximate a first end of the oval profile in alignment with the IDC slot 10 when assembled to the housing 4. The actuator 14 further comprises an IDC receiving slot 32 transversely intersecting the wire receiving cavity 16, and a screwdriver groove 34 extending into the actuator from an outer end face 36.

Figure 2:
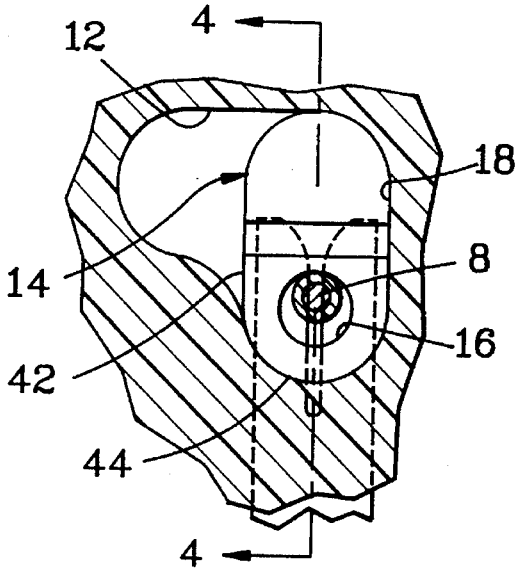
FIG. 2 is the same view as FIG. 1 but showing the actuator in a fully terminated position.
Figure 3:
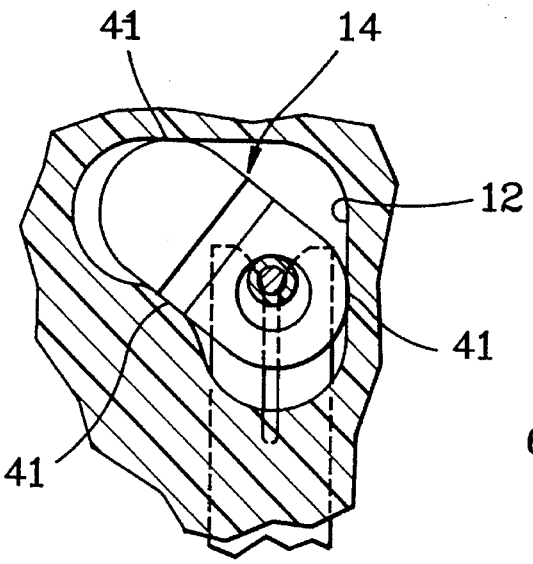
FIG. 3 is a similar view to FIGS. 1 and 2 but showing the actuator in an intermediate position.
Figure 4:
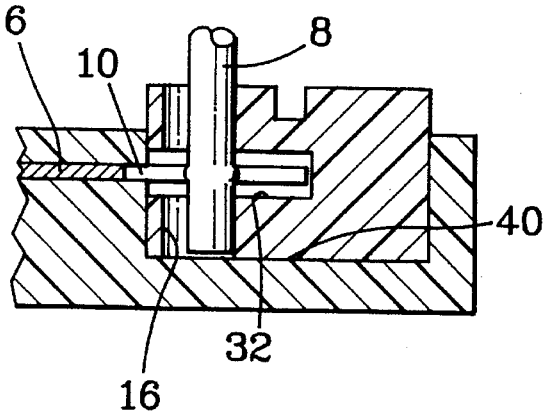
FIG. 4 is a cross-sectional view through lines 4—4 of FIG. 2.

Connection of a wire 8 to the IDC 6 will now be described. Prior to connection, the actuator 14 is in the position as shown in FIG. 1 whereby the wire receiving hole 16 is spaced away from a receiving end 38 of the IDC slot 10 thus allowing a conducting wire 8 to be inserted therein until the end of the wire abuts a bottom wall 40 of the cavity 12. In the disconnected position as shown in FIG. 1, the longitudinal axis of the oblong profile 30 is transverse to the IDC slot 10, and in this particular example, is in fact orthogonal thereto, although the latter is not necessary. Torque is then applied to the actuator 14 by using a screwdriver, for example, inserted into the screwdriver slot 34. The torque causes rotation of the actuator 14 whereby the outer profile 30 cooperates in a three-point contact 41 with the portions 18, 22 and 24 of the cavity surface 18, an intermediate position of which is shown in FIG. 3. A translation of the actuator also occurs such that the trajectory of the wire receiving cavity 16 is linear and aligned with the IDC slot 10 for stuffing the wire thereinto. The fully connected position of the actuator 14 is shown in FIG. 2 whereby the actuator profile's longitudinal axis is parallel to the wall portion 18 of the cavity 12. The oval profile 30 comprises planar side surfaces 42 and semi-circular end surfaces 44, the centre of which is also the centre of the wire receiving cavity 16 in order to effectuate the linear translation of the wire receiving cavity 16 during rotation of the actuator 14 whilst camming against the linear wall portion 18. It would however of course be possible to have other profiles of the actuator 14 and cooperating camming surfaces, 18, 22, 24 whilst nevertheless providing a linear translation of the wire receiving cavity 16. Furthermore, it also be conceivable to have an arcuate IDC slot and a corresponding arcuate movement of the wire.

Disconnection of the wire from the IDC 6 is effectuated by simply applying reverse torque in the same manner to the actuator 14.

Figure 5:
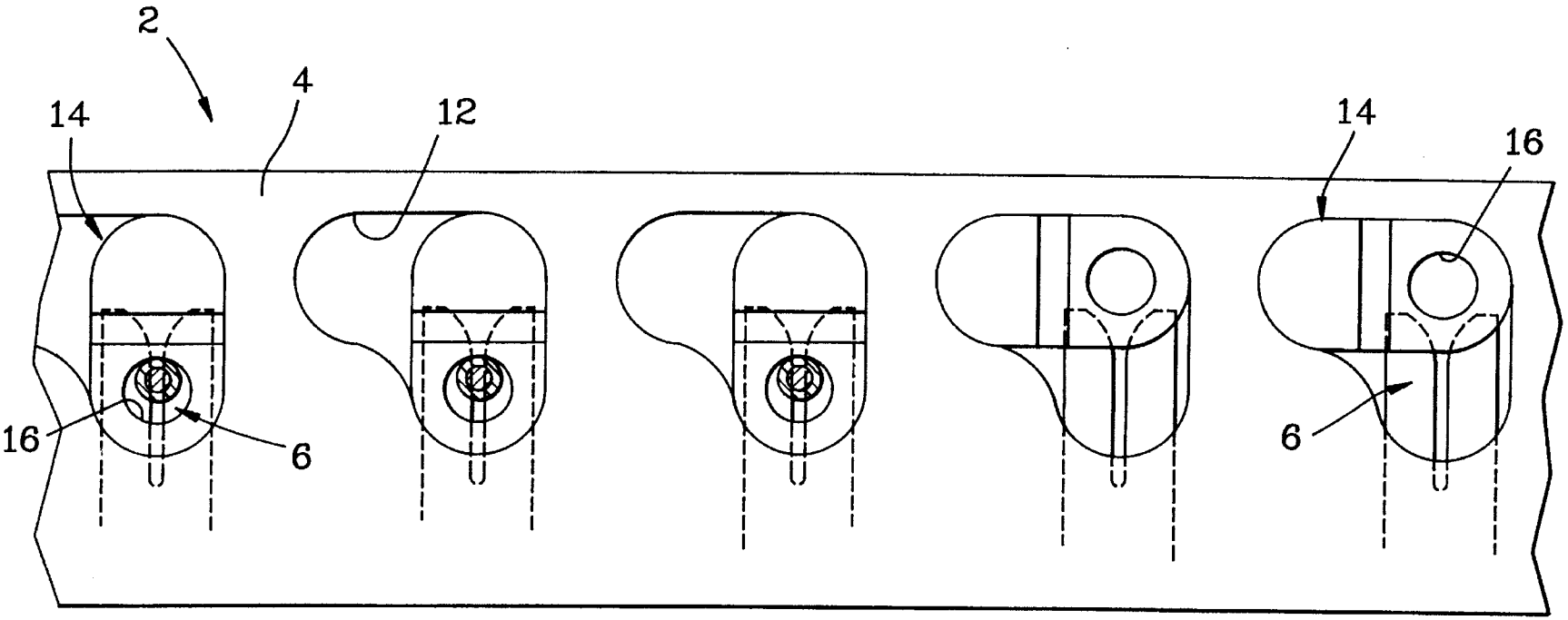
FIG. 5 is a partial view of a connector comprising a plurality of IDCs.
Figure 6:
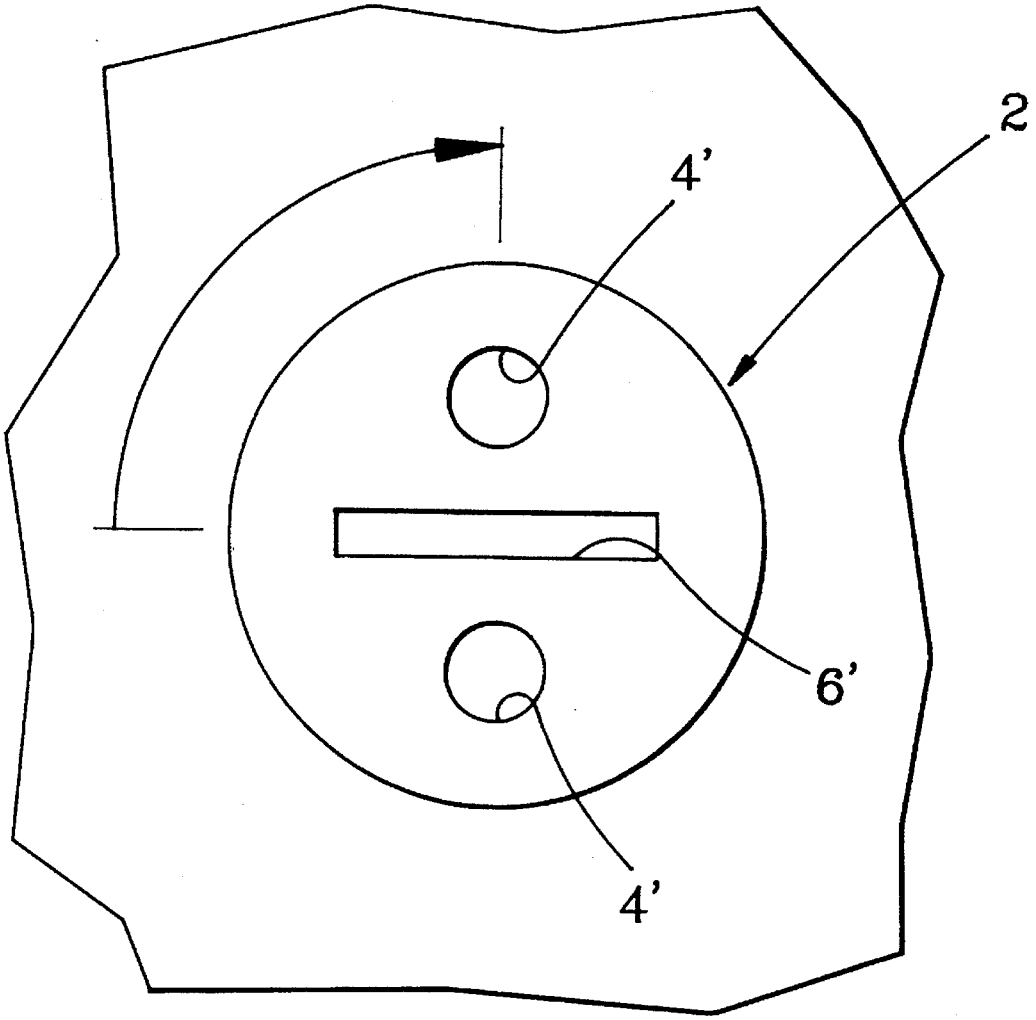
(PRIOR ART) Fig. 6
FIG. 6 is a partial plan view of a prior art actuator in a housing cavity therefor.

Referring now to FIG. 5, a larger portion of the connector 2 is shown comprising plurality of juxtaposed IDCs 6 and corresponding actuators 14, some of which are shown in the connected position and others in the disconnected position.

Advantageously, the access for insertion of the conducting wires into the wire receiving cavities 16 is possible from the same direction than that of the actuation tool e.g. a screwdriver for simply torqueing the actuator to connect or disconnect the wires. Furthermore, the accessibility, the shape of the actuators and their differently angled positions in the disconnected and connected orientations allow for quick and reliable visual inspection of whether the connection has been correctly terminated or not. Additionally, the design is not only very compact but also cost-effective due to the simplicity of the parts such as the planar edge-stamped IDC's 6, the linear IDC slots, the simple prismatic cavity 12, and also the few number of parts; the actuator 14 requiring no separate pivot or other means.

I claim:

1. An insulation displacing contact (IDC) connector comprising an insulative housing, an insulation displacing contact mounted therein for connection to a conducting wire, and an actuator for guiding and inserting the wire into a slot of the IDC, characterized in that the housing comprises a cavity for receiving the actuator, the housing cavity having a camming surface cooperable with the actuator for guiding simultaneous rotational and translational movement thereof during insertion of the wire into the IDC slot, the actuator further comprising a wire receiving cavity proximate the IDC slot and extending substantially parallel to the rotational axis of the actuator.

2. The connector of claim 1 characterized in that the camming surface is profiled to cooperate with the actuator such that the wire is guided in a substantially linear manner in the IDC slot, the IDC slot being substantially linear.

3. The connector of claim 1 characterized in that the IDC is a substantially planar edge stamped sheet metal part.

4. The connector of claim 1 characterized in that rotational and translational movement of the actuator is two-dimensional.

5. The connector of claim 1 characterized in that the wire receiving cavity of the actuator extends in a direction substantially perpendicular to the IDC slot.

6. The connector of claim 1 characterized in that the actuator comprises a slot extending across an outer end face thereof for receiving a tool to exert torque on the actuator.

7. The connector of claim 1 characterized in that the wire receiving cavity and a tool receiving slot on an end face of the actuator for receiving a tool to rotate the actuator, are accessible from a common direction directed towards the end face.

8. The connector of claim 1 characterized in that the actuator is a unitary part movably attached to the connector by the IDC.

9. The connector of claim 1 characterized in that the connector comprises a plurality of juxtaposed IDCs, cavities and actuators therefor.

10. The connector of claim 1 characterized in that the camming surface is substantially prismatic and extends parallel to the wire receiving cavity of the actuator.

11. The connector of claim 10 characterized in that the actuator has a substantially prismatic shape of oblong cross-sectional profile, the wire receiving cavity being disposed proximate one end of the oblong profile.

12. The connector of any preceding claim characterized in that the actuator comprises a contact receiving slot intersecting the wire receiving cavity for receiving the IDC therein.

* * * * *